US008544785B2

(12) United States Patent
Pelland et al.

(10) Patent No.: US 8,544,785 B2
(45) Date of Patent: Oct. 1, 2013

(54) DISCRIMINATING WEB MATERIAL DISPENSER

(75) Inventors: Mike Pelland, Princeton, WI (US); Steve Reckamp, Crystal Lake, IL (US)

(73) Assignee: San Jamar, Inc., Elkhom, WI (US)

( * ) Notice: Subject to any disclaimer, the term of this patent is extended or adjusted under 35 U.S.C. 154(b) by 507 days.

(21) Appl. No.: 12/739,331

(22) PCT Filed: Oct. 22, 2008

(86) PCT No.: PCT/US2008/080793

§ 371 (c)(1), (2), (4) Date: Jun. 24, 2010

(87) PCT Pub. No.: WO2009/055473

PCT Pub. Date: Apr. 30, 2009

(65) Prior Publication Data

US 2011/0133010 A1 Jun. 9, 2011

Related U.S. Application Data

(60) Provisional application No. 60/981,705, filed on Oct. 22, 2007.

(51) Int. Cl.
*B65H 43/00* (2006.01)

(52) U.S. Cl.
USPC ..... 242/563; 242/564.1; 242/596.7

(58) Field of Classification Search
USPC ..... 242/564, 564.1, 564.2, 563, 596, 242/596.7; 312/34.22, 34.8; 235/462.01, 235/462.13, 454, 470
See application file for complete search history.

(56) References Cited

U.S. PATENT DOCUMENTS

| | | | |
|---|---|---|---|
| 4,620,184 | A | 10/1986 | Nedstedt |
| 4,666,099 | A | 5/1987 | Hoffman et al. |
| 4,721,265 | A | 1/1988 | Hawkins |
| 4,786,005 | A | 11/1988 | Hoffman et al. |
| 4,790,490 | A | 12/1988 | Chakravorty |
| 4,796,825 | A | 1/1989 | Hawkins |
| 4,826,262 | A | 5/1989 | Hartman et al. |
| 4,960,248 | A | 10/1990 | Bauer et al. |
| 5,086,526 | A | 2/1992 | Van Marcke |
| 5,452,832 | A | 9/1995 | Niada |
| 5,694,653 | A | 12/1997 | Harald |
| 5,727,579 | A | 3/1998 | Chardack |
| 5,772,291 | A | 6/1998 | Byrd et al. |
| 5,963,135 | A | 10/1999 | Van Marcke |
| 5,984,049 | A | 11/1999 | Lammers |
| 6,105,898 | A | 8/2000 | Byrd et al. |
| 6,279,777 | B1 | 8/2001 | Goodin et al. |

(Continued)

OTHER PUBLICATIONS

PCT—Notification Concerning Transmittal of IPER (PCT/US2008/080793).

(Continued)

*Primary Examiner* — William A Rivera
(74) *Attorney, Agent, or Firm* — Boyle Fredrickson, S.C.

(57) ABSTRACT

An automatic product dispenser determines if the roll loaded into the dispenser is approved for use with the dispenser. The core of a roll contains a feature that alters an electromagnetic field created proximate the core. The alteration of the electromagnetic field may then be used to determine if the core, and thus the roll, is usable with the dispenser. The feature is designed such that it is damaged once product is completely dispensed from the roll thereby preventing replenishment and reuse of a spent roll.

16 Claims, 8 Drawing Sheets

(56) References Cited

U.S. PATENT DOCUMENTS

| | | | | |
|---|---|---|---|---|
| 6,293,486 | B1 | 9/2001 | Byrd et al. | |
| 6,388,609 | B2 | 5/2002 | Paese et al. | |
| 6,412,655 | B1 | 7/2002 | Stuetzel et al. | |
| 6,412,679 | B2 | 7/2002 | Formon et al. | |
| 6,502,784 | B1 | 1/2003 | Sato | |
| 6,592,067 | B2 | 7/2003 | Denen et al. | |
| 6,695,246 | B1 | 2/2004 | Elliott et al. | |
| 6,731,209 | B2 | 5/2004 | Wadlow et al. | |
| 6,736,348 | B1 | 5/2004 | Formon et al. | |
| 6,745,927 | B2 | 6/2004 | Formon et al. | |
| 6,820,785 | B2 | 11/2004 | Kapiloff | |
| 6,838,887 | B2 | 1/2005 | Denen et al. | |
| 6,854,684 | B2 | 2/2005 | Byrd et al. | |
| 6,892,620 | B2 | 5/2005 | Kapiloff | |
| 6,903,654 | B2 | 6/2005 | Hansen et al. | |
| 6,953,171 | B2 | 10/2005 | Takashima | |
| 6,977,588 | B2 | 12/2005 | Schotz et al. | |
| 6,988,689 | B2 | 1/2006 | Thomas et al. | |
| 7,040,566 | B1 | 5/2006 | Rodrian et al. | |
| 7,213,782 | B2 | 5/2007 | Osborne et al. | |
| 7,240,873 | B2 | 7/2007 | Eikmeier et al. | |
| 7,240,874 | B2 | 7/2007 | Eikmeier et al. | |
| 7,264,194 | B2 | 9/2007 | Gassner et al. | |
| 7,370,824 | B1 | 5/2008 | Osborne | |
| 7,533,845 | B2 * | 5/2009 | Neveu et al. | 242/563 |
| 8,160,742 | B2 * | 4/2012 | Goerg et al. | 700/240 |
| 8,165,716 | B1 * | 4/2012 | Goeking et al. | 700/237 |
| 2001/0017309 | A1 | 8/2001 | Formon et al. | |
| 2002/0109035 | A1 | 8/2002 | Denen et al. | |
| 2003/0041716 | A1 | 3/2003 | Takashima | |
| 2003/0167893 | A1 | 9/2003 | Morris et al. | |
| 2003/0189125 | A1 | 10/2003 | Trierenberg | |
| 2005/0006520 | A1 | 1/2005 | Gassner et al. | |
| 2005/0011987 | A1 | 1/2005 | Lemaire et al. | |
| 2005/0167541 | A1 | 8/2005 | Osborne | |
| 2006/0006275 | A1 | 1/2006 | Neveu et al. | |
| 2007/0228207 | A1 | 10/2007 | Ikezawa | |

OTHER PUBLICATIONS

International Search Report and Written Opinion (PCT/US2008/080793).

* cited by examiner

DISCRIMINATING WEB MATERIAL DISPENSER

CROSS-REFERENCE TO RELATED APPLICATIONS

This application claims priority to U.S. Provisional Patent Application No. 60/981,705 filed on Oct. 22, 2007 and entitled "Discriminating Web Material Dispenser," the entirety of which is hereby incorporated by explicit reference thereto.

BACKGROUND OF THE INVENTION

The present invention is generally directed to product dispensers and, more particularly, to a dispenser having a lockout feature that prevents the dispensing of product from a non-approved source.

Automatic towel and similar product dispensers have been developed to reduce the waste generally associated with manual dispensers. Automatic dispensers typically include a motor driven drive roller that advances web material, such as hand towel material, from a web material roll. Early automatic dispensers required a user to depress a feed button to activate the drive roller. More recently, automatic dispensers have incorporated proximity sensor technology to allow hands-free or otherwise contact-free activation of the drive roller.

Conventional automatic dispensers advance web material from the web material roll according to predetermined settings that result in the same amount of web material being dispensed regardless of the particular characteristics of the web material to be dispensed. For example, a conventional automatic towel dispenser will advance a fixed amount of web material from a web material roll independent of the absorbency of the web material. As a result, it is possible for too much or too little web material to be dispensed; both of which can lead to waste. When too much web material is dispensed, the excess cannot be retrieved and reused and therefore creates waste. When too little web material is dispensed, a user will often retrigger the dispenser to dispense additional web material possibly resulting in additional waste.

Accordingly, a number of "smart" dispensers have been developed that are able to obtain information about certain characteristics of a web material roll, or the web material wrapped therearound, and adjust the dispensing settings accordingly. One such dispenser is described in U.S. Pat. Pub. No. 2005/0171634. This publication describes a dispenser having a reader or scanner that communicates with an RFID "smart" chip or tag embedded in the core of a roll. The smart chip includes information relating to the type of product to be dispensed. For a roll of hand towel material, that information may include absorbency, basis weight, and manufacturer. The scanner reads this information from the smart chip and communicates that information to a processor that adjusts performance settings accordingly. For example, the feed length may be adjusted based on the information contained in the smart chip. Additionally, the processor may disable the automatic drive or feed components if an unapproved or unrecognized roll is loaded into the dispenser. The automatic drive components may also be disabled if no information is gathered from the smart chip, which may occur when a roll absent a smart chip is loaded into the dispenser. This "lockout" feature is intended to reduce jamming of the dispenser, damage to the dispenser, and/or unsatisfactory dispensing of web material that may result from use of an unapproved or an unrecognized roll.

In addition to significantly adding to the cost of each roll and the dispenser itself by virture of the necessary reader(s) and circuitry, such smart chips or RFID tags are only effective if the web material of the roll matches the information encoded in the smart tag. If there is a mismatch between the web material and the encoded information, the performance settings of the dispenser will not be tailored to the specifics of the web material to be dispensed. Further, the lockout feature is designed to prevent the use of unauthorized or unrecognized rolls with the automatic dispenser. If there is an inconsistency between the encoded information and the actual web material to be dispensed, the lockout feature may not function properly.

Another "smart" dispenser, which is described in U.S. Pat. No. 7,040,566, uses a bar code-embedded roll and a bar code reader to determine if the roll is from an authorized source before the dispenser is activated to dispense material from the roll. The bar code reader is described as a phototransistor reflective object sensor that reads the bar code associated with a roll loaded into the dispenser and transmits a code signal to a controller that compares the code signal to a set of approved codes maintained in a computer readable database. If the code associated with the code signal does not match an approved code, the dispenser is automatically locked out form dispensing material from the loaded roll.

While such a smart dispenser is believed to be effective in preventing unauthorized rolls from being loaded into a dispenser, the cost and the collective size of the components can result in a significant increase in the overall cost, complexity, and size of the dispenser. For example, such a lockout system requires not only the aforementioned bar code reader/sensor and microcontroller but also an analog to digital converter for digitizing the analog output of the reader.

The above-described systems can also often be circumvented by removing the bar code or RFID tag and placing them on the core of a new roll or merely in appropriate proximity to the reader. The dispenser can then be loaded with an unapproved or unrecognized roll and be caused to operate as if an approved or recognized roll has been loaded. As a result, the waste management, performance and supply control advantages provided by the smart chips or RFID tags may not be realized.

BRIEF DESCRIPTION OF THE INVENTION

The present inventors have found that the advantages provided by smart chips, bar code readers, or RFID tags can be realized while avoiding the pitfalls and costs associated therewith. More particularly, the present invention is directed to an automatic web material dispenser that determines if the roll loaded into the dispenser is approved for use with the dispenser. In one embodiment of the present invention, in order to achieve this result, it compares a baseline system frequency to the frequency after the roll has been loaded into the dispenser and determines if changed frequency is within a predetermined range. If so, then the roll is approved for use with the dispenser and the dispenser is activated. Preferably, the roll is designed with a frequency changing device or material that it is damaged once the web material is completely or substantially dispensed from the roll. Thus, the core cannot be reloaded with web material that may not be approved for use with the dispenser. Preferably, when the appropriate modified frequency is recognized, the system can be set to adjust for various particulars of the web material to be dispensed, such as brand name, type, size, and the like, that can be used to automatically tailor the performance settings of the dispenser.

It is therefore one object of the present invention to provide an automatic product dispenser having a lockout feature that cannot be easily circumvented.

It is a further object of the invention to provide a roll having a recognition device or material that cannot be transferred to other rolls.

Therefore, in accordance with one aspect of the present invention, an apparatus for dispensing product from a roll is disclosed. The apparatus includes a drive roller adapted to advance product from a roll. The roll to be loaded into the dispenser includes a frequency changing device or material that may be indicative of the product carried by the roll or merely the source or provider of the roll. The apparatus further includes a controller associated with the drive roller and adapted to determine the frequency resulting from the presence of the frequency changing device or material of the roll, compare the system base frequency to the changed frequency and then, if the changed frequency matches a predetermined frequency, falls within a predetermined range, is changed a predetermined amount or percentage, permit the drive roller to advance the product from the roll. If the changed frequency does not match the predetermined frequency, shift or range, then the drive motor will not be actuated, thereby preventing the dispensing system from operating to advance product from the roll.

In accordance with another aspect, the present invention includes a method of regulating product dispensing from a dispenser. The method includes determining if a roll includes a frequency shifting device or material that fits the predetermined profile. If it does, then the dispensing particulars of the roll can be known and/or set.

According to another aspect, the present invention includes a roll of web material for use with an automatic dispensing device. The roll has a frequency shifting device or material identifying a brand or source of the roll associated therewith.

Other objects, features, and advantages of the invention will become apparent to those skilled in the art from the following detailed description and accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout.

In the drawings.

DETAILED DESCRIPTION OF THE INVENTION

The present invention will be described with respect to an automatic towel dispenser for dispensing web material, but it is recognized that the invention is applicable to automatic dispensers adapted to automatically dispense other types of products, including other paper and non-paper products. Additionally, the invention is applicable with touch-based and touchless automatic dispensers, such as those commercially available from The Colman Group, Inc. of Elkhorn, Wis.

As will be explained in greater detail further below, the present invention is generally directed to a dispenser, such as a paper towel dispenser, that includes circuitry for generating an electromagnetic field generally around a roll mount. When an authorized roll is mounted onto the roll mount, the roll will cause a change in the frequency of the electromagnetic field. More particularly, the circuitry includes a frequency generator (oscillator) and a coil for creating the electromagnetic field and the roll includes a uniquely constructed closed loop. Thus, when the roll is loaded into the dispenser, the frequency generator will generate a new waveform having a changed frequency reflective of the mutual inductance between the coil and the closed loop. The new waveform, or one or more characteristics thereof, are result of the properties of the closed loop. The new waveform, or some form thereof, may then be analyzed to determine if the roll loaded into the dispenser is authorized for use with the dispenser. If so, the dispenser will dispense material from the roll. If not, operation of the dispenser will be locked out thereby preventing unintended or impermissible use of the dispenser.

Figure 1:
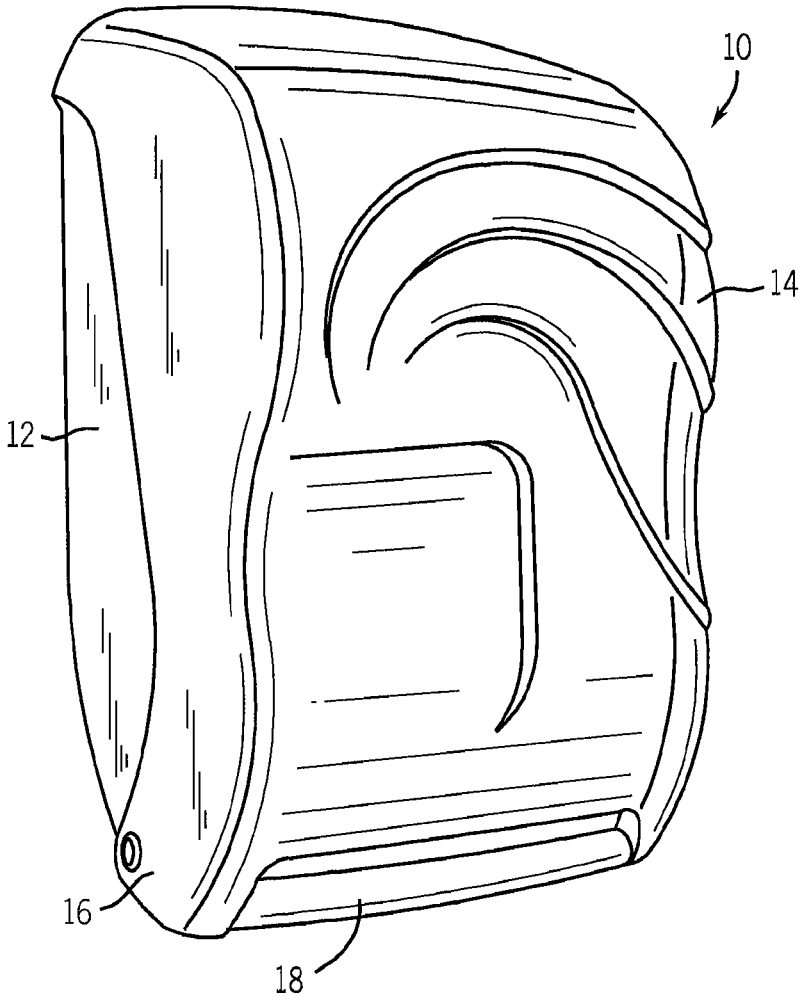
FIG. 1 is an isometric view of an automatic towel dispenser.

An exemplary paper towel dispenser is shown in FIG. 1. Automatic towel dispenser 10 includes a back cover 12 designed to be wall-mounted and a front cover 14 coupled to the back cover 12 by a hinge 16. Paper towel or web material is fed from a web material roll (not shown) contained within the automatic towel dispenser 10 through dispensing slot 18 by a drive assembly 20, shown in FIG. 2. The clamshell design of the automatic towel dispenser 10 allows a roll to be loaded into the automatic towel dispenser 10 by unlocking the front cover 14 from the back cover 12 in a known manner and then rotating the front cover 14 downwardly about hinge 16.

Figure 2:
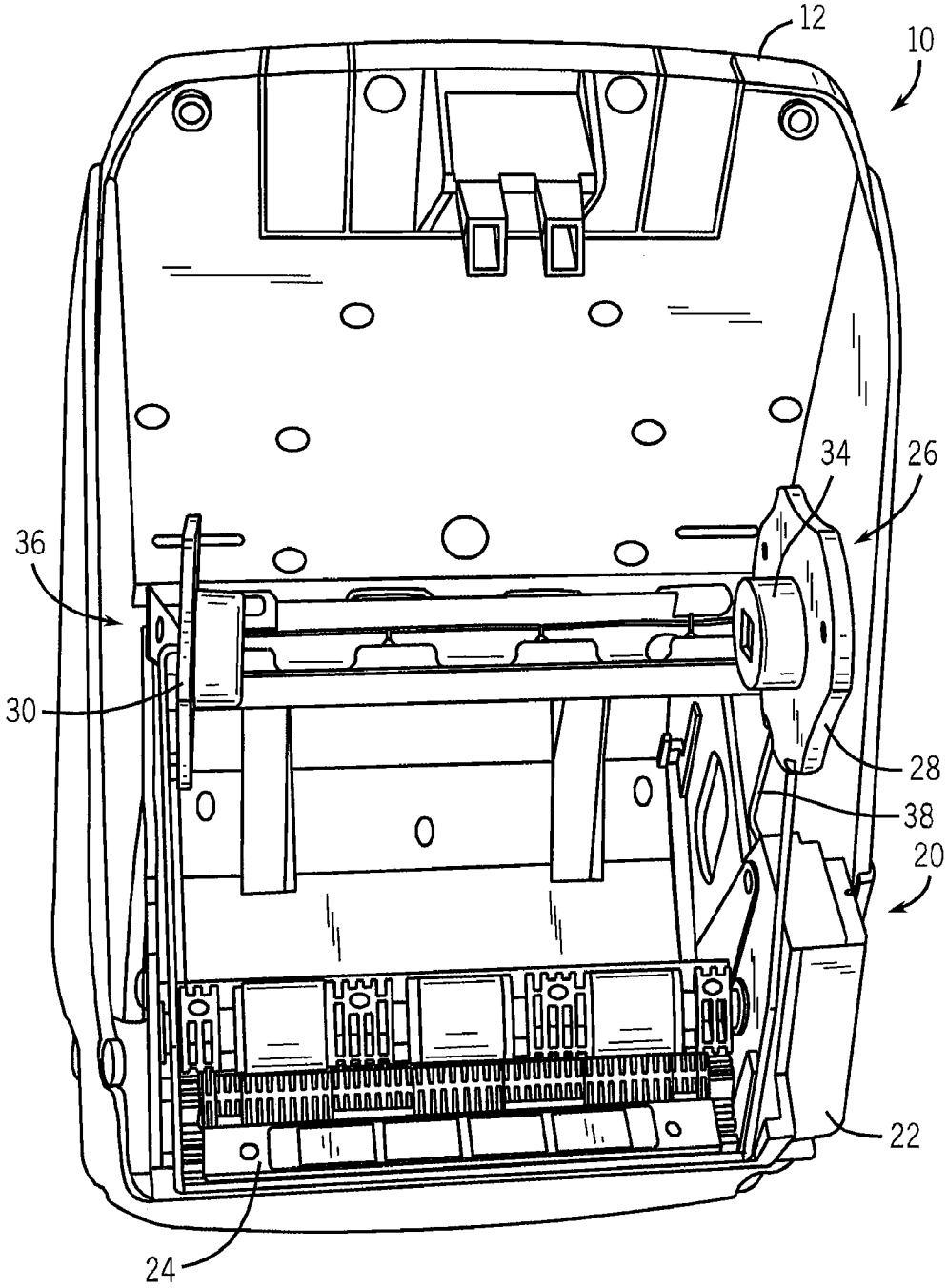
FIG. 2 is a front elevation view of the automatic towel dispenser of FIG. 1 with the front cover removed.

As shown in FIG. 2, drive assembly 20 is mounted to the back cover 12 and includes a PC board and motor contained within housing 22 and operatively associated, in a known manner, with a drive roller assembly 24. The drive roller assembly 24 is designed to grab and forcibly advance web material from a roll of web material (not shown) through dispensing slot 18. The drive roller assembly 24 may be of conventional design, such as that described in U.S. Pat. No. 7,168,653, the disclosure of which is incorporated herein by reference. As will be described in greater detail below, the motor may be controlled by a processor adapted to smartly control operation of the motor and drive roller assembly, including, when appropriate, disablement of the motor so as to lock out its functionality when an unapproved roll is loaded into the automatic towel dispenser 10.

Figure 3:
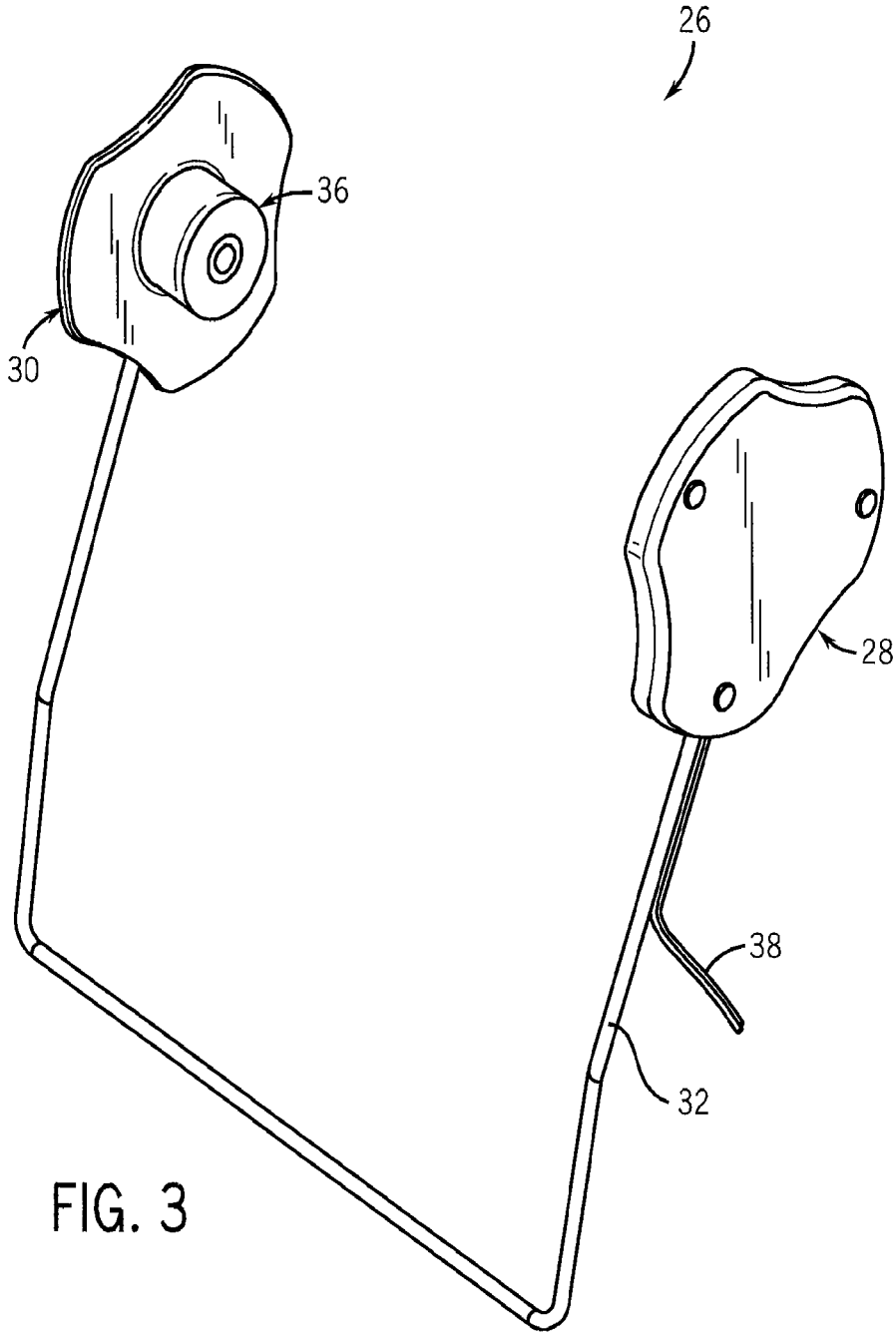
FIG. 3 is an isometric view of a roll carrier assembly for use with the automatic towel dispenser of FIGS. 1-2.
Figure 4:
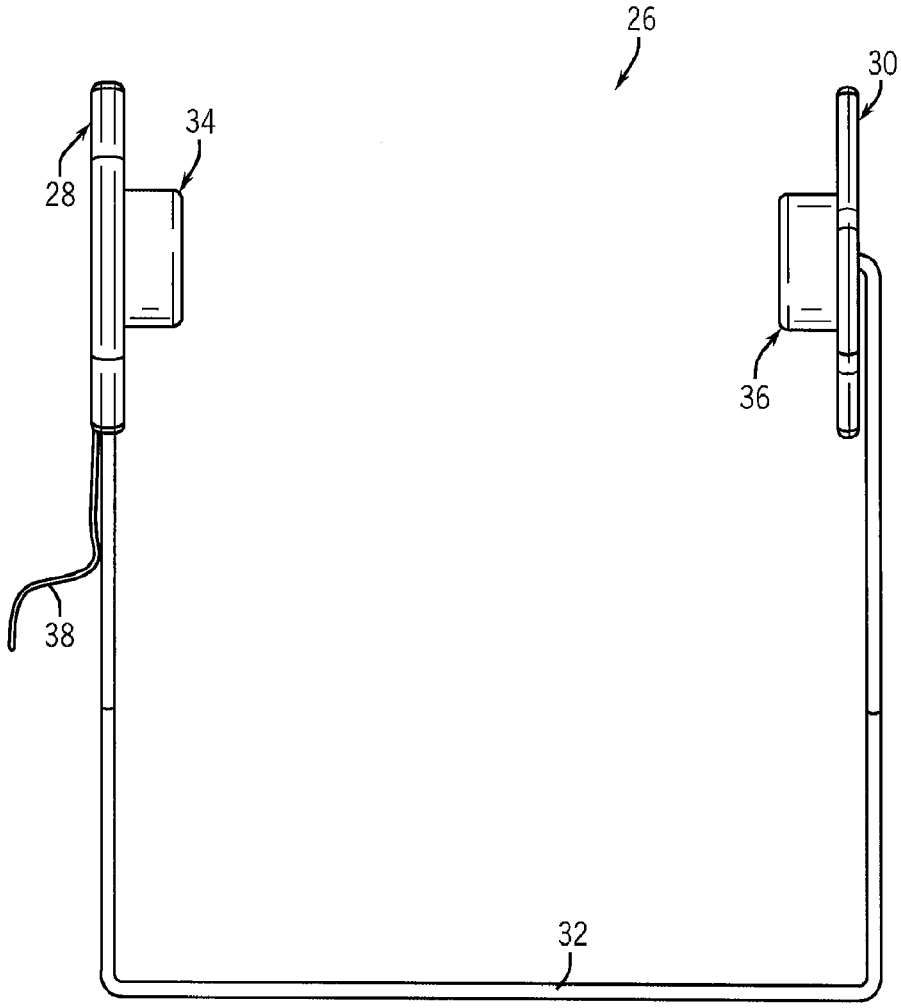
FIG. 4 is front elevation view of the roll carrier assembly shown in FIG. 3.

In one embodiment of the present invention, a continuous sheet of web material is advanced from a roll (not shown) that is preferably mounted on a carrier assembly 26 of the type that includes a pair of roll support plates 28, 30 that carry a guide wire 32, as shown further in FIGS. 3-4. Each support plate 28, 30 has an inwardly facing hub 34, 36, respectively, that is designed to extend partially through the hollow core of the roll. The hubs 34, 36 have a generally circular cross-section to match that of the hollow core of the roll so that roll can smoothly rotate about the hubs 34, 36 as web material is advanced from the roll and dispensed through dispensing slot 18. As further shown in FIG. 2, a wire 38 extends from the hub 34 to an oscillator within housing 22. As will be explained, the oscillator and a coil create an electromagnetic field generally about the hub 34.

Figure 5:
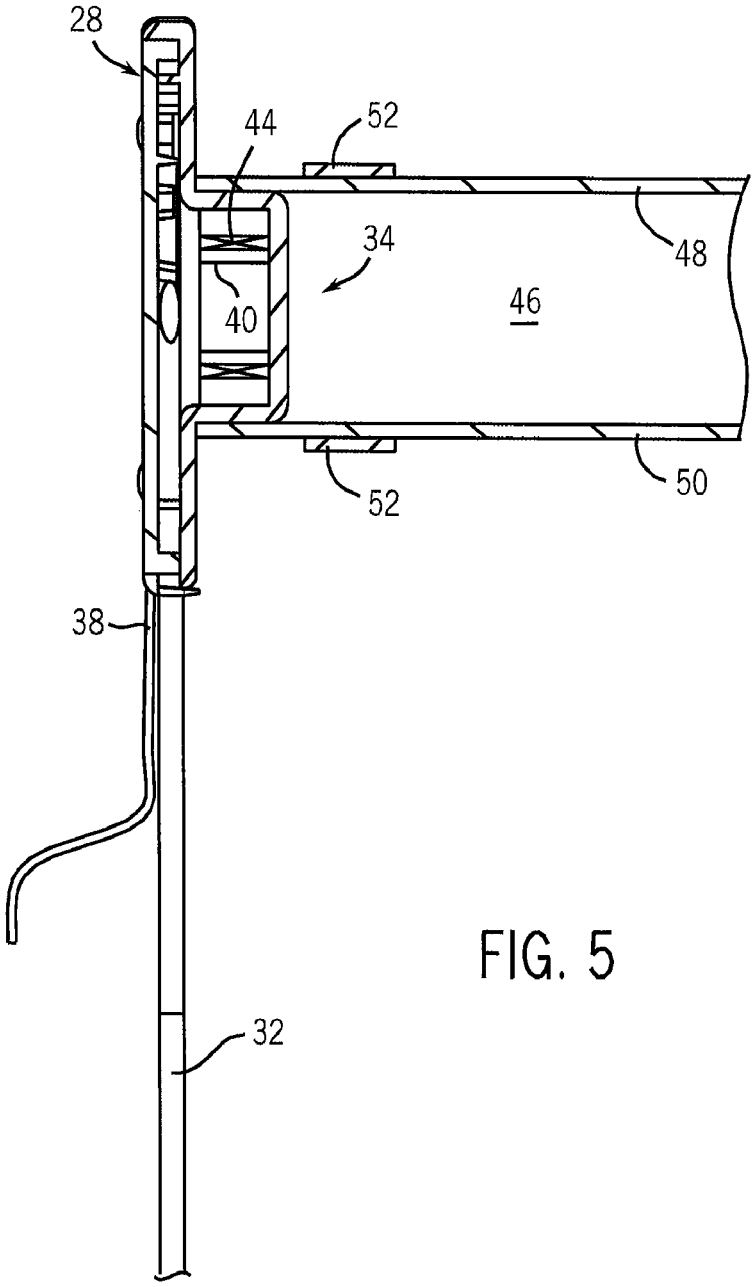
FIG. 5 is a section view of a portion of the roll carrier assembly shown in FIGS. 3 and 4.

Referring to FIG. 5, the hub 34 provides a housing for a bobbin 40 around which a coil (wire winding) 44 may be wrapped. When the coil 44 is energized, an electromagnetic field is generated. As noted above, the hub 34 is received by one end of the hollow core 46 of the roll. The core 46 has an inner surface 48 and an outer surface 50. The outer surface 50 is impregnated or otherwise carrier a continuous ring of conductive material 52. Alternately, the conductive material 52 could be placed on the inner surface 48, or both the inner and outer surfaces 48, 50, or impregnated in the core material. In the illustrated embodiment, the conductive material 52 is arranged in the form of a ring that envelopes a portion of the outer surface 50 of the core 46. The conductive ring of material 52 (or alternatively, a closed circuit (not shown) or other type of closed loop) is designed to modify the base system frequency as it interacts with the electromagnetic field of the coil. For example, the conductive material 52 for a given core may include one or more of copper, gold, nickel and silver. The width, thickness, purity, type and location of the conductive material can affect the degree of frequency shift or change. In one embodiment, the amount of frequency changing device or material can be used to identify the brand of the roll.

In one embodiment, the closed loop 52 is formed as a ring of conductive material around a portion of a roll core 46. It is recognized, however, that in alternate embodiments, the closed loop 52 may be arranged in other patterns to uniquely identify the roll. For example, multiple rings of conductive material 52 could be used. In one embodiment, one type of conductive material 52 is used, but is recognized that mixtures of various types of conductive material 52 could be used. Regardless of the contents of the conductive material 52 and how it is placed on the roll, the resulting frequency can uniquely identify the brand, source, or some other defining characteristic of the roll so that a determination can be made as to whether the roll may be used with the automatic towel dispenser 10. The resulting frequency may also identify the type of material, the size of the roll, and other parameters that may be useful in establishing operating parameters for the automatic towel dispenser 10.

Figure 6:
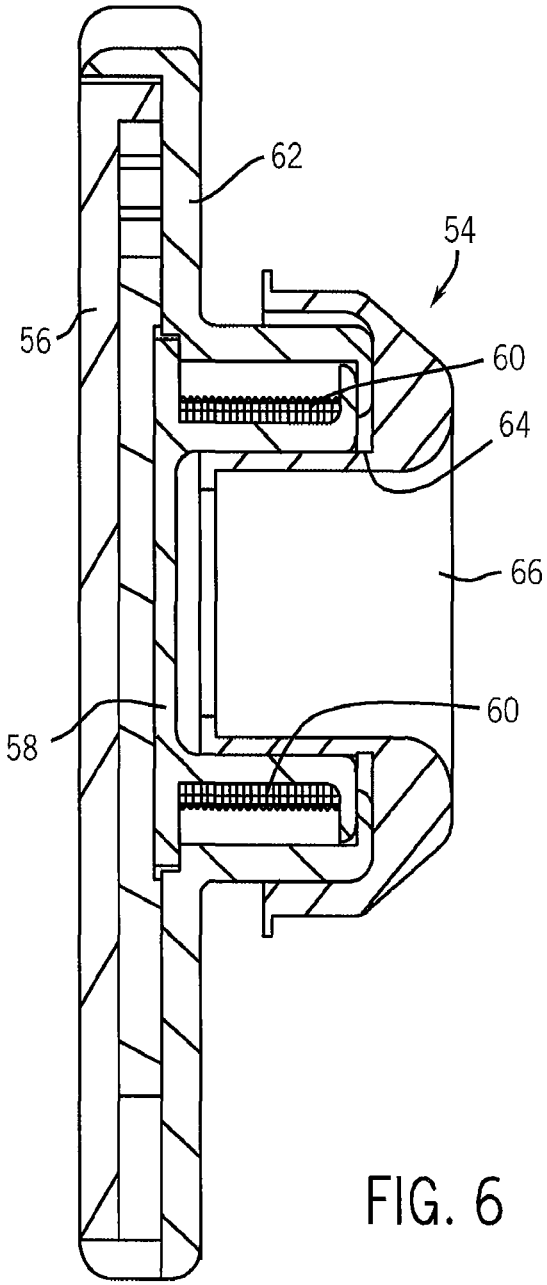
FIG. 6 is section view of a hub assembly according to another embodiment of the invention.
Figure 7:
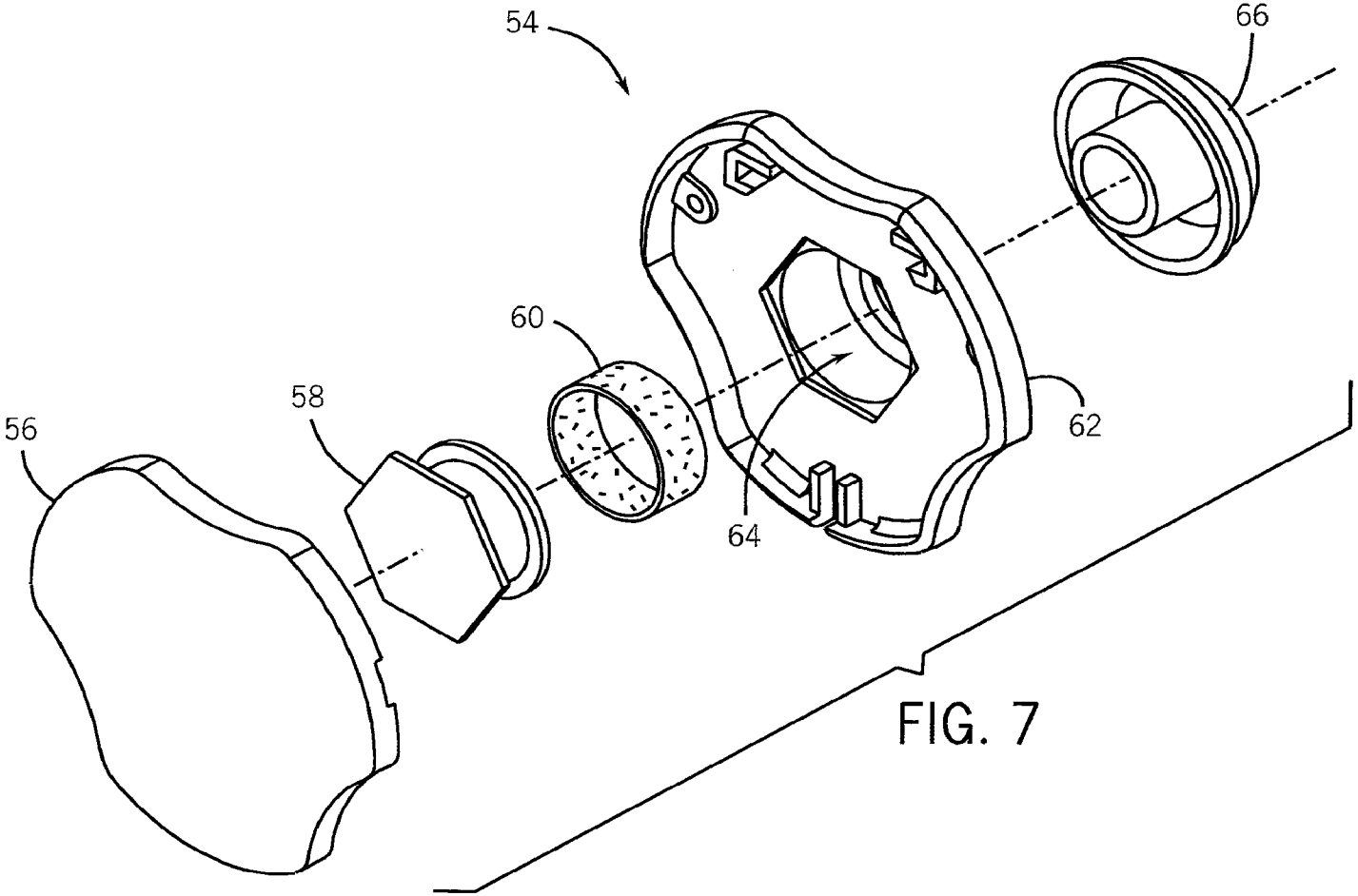
FIG. 7 is an exploded view of that shown in FIG. 6.

FIGS. 6 and 7 show a hub assembly 54 according to another embodiment of the invention. Hub assembly 54 includes a support plate 56 to which a bobbin 58 is affixed in a known manner. A coil winding 60 is mounted to the bobbin 58, and a cover 62 having an opening 64 fits over the bobbin 58 and thus coil 60. An end cap 66 snaps into or is otherwise retained by the bobbin 58. The end cap 66 fits within the hollow core of the roll. In one embodiment, the shape of the end cap 66 and the core of the roll are matched such at rolls having cores with non-complementary shapes cannot be used with the dispenser.

Figure 8:
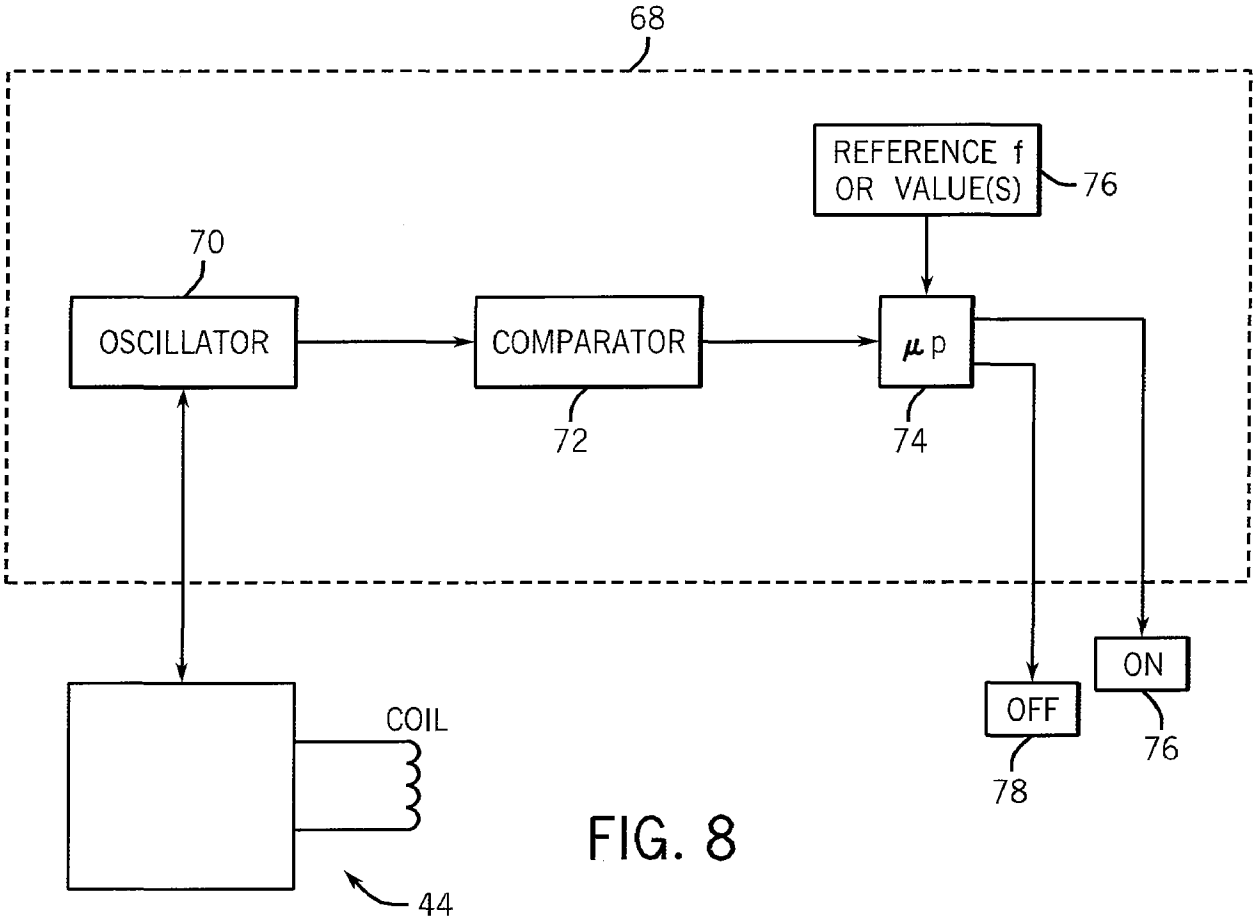
FIG. 8 is a schematic view of a control circuit associated with the product discriminating assembly.

As shown in FIG. 8, the system of the present invention includes a control logic circuit 68 which includes an oscillator 70 which together with coil 44 generates an electromagnetic field proximate the coil 44 and thus a roll positioned over the hub 34. The oscillator 70 and the coil 44 generate the electromagnetic field at a predetermined frequency which establishes a base system frequency. When a roll having an inductive element, e.g., a ring of conductive material, associated therewith is brought into proximity of coil 44, preferably by mounting the roll on the hub 34, the mutual inductance between the coil 44 and the inductive element will cause the oscillator to generate a waveform of a different frequency than that of the base system frequency. The output of the oscillator, i.e., waveform, is input to a frequency sampler 72 (e.g., an op-amp, logic gate, comparator, etc.) which effectively determines the frequency of the new waveform generated by the oscillator. The frequency, in effect, is representative of the mutual inductance generated by placement of the roll onto the hub. A microprocessor 74 analyzes the output of the comparator and, more particularly, compares the frequency, or some characteristic value thereof, to a reference value 76. The reference value corresponds to a value indicative of an authorized roll. In this regard, the microprocessor 74 includes, or access memory, containing one or more reference values representative of various authorized roll types, brands, etc.

It will be appreciated that the aforementioned comparison can take many forms. For example, the comparison can be done by measuring the percent of change of the mutual inductance relative to the system frequency, i.e., output of the oscillator before the roll is placed on or proximate the hub. If the comparison yields a match against the reference, the control logic circuit energizes the system enabling the drive motor to drive the drive roller and dispense web material, as indicated by block 76. If there is no match, the system is not energized and no material can be dispensed, as represented by block 78. The automatic towel dispenser 10 may include an indicator LED, for example that is illuminated when the lockout feature is activated.

If an unauthorized roll core is loaded on the carrier assembly, the measured frequency or other value will not match the reference frequency or value thus indicating that an unauthorized roll has been loaded on the carrier. It is recognized that the web material dispenser 10 may be adapted to drive multiple types of rolls. Thus, in one preferred embodiment, the automatic dispenser includes a database that is loaded with multiple reference frequencies or values. It is further contemplated that suitable diagnostic tools may be used to provide in-field updates to the database.

At least five preferred embodiments are contemplated for providing the closed loop on or in association with the roll of web material in order to provide a means to cause a frequency change in accordance with the present invention. In the first embodiment, a roll core is coated or impregnated with at least one ring of conductive material. The core can be coated on the inside, on the outside or have the conductive material impregnated somewhere between the inside and outside of the core. In the second embodiment, an insert is provided which can removably or permanently placed inside the core. The insert can be in the form of a plastic or paperboard plug that includes a ring of conductive material or other closed loop. In a third embodiment of the present invention, a label in the form of a ring impregnated with conductive material can be affixed to the side of the roll of web material. In a fourth embodiment of the present invention, the web material itself can be coated or impregnated with conductive material to form a ring giving the appearance of, for example, a colored stripe used to indicate the end of a roll of register tape. In the fifth embodiment, a removable paper or other band coated or impregnated with a conductive material that encircles the roll of web material at the time of mounting of the web material in the dispenser could be used. In such case, the band would be removed prior to threading the dispenser for feeding the dispenser, but after the activation of the dispenser had occurred. In this embodiment, upon activation, the dispenser would preferably be set up to dispense an amount of a paper commensurate with that on the roll, prior to reactivation.

Figure 9:
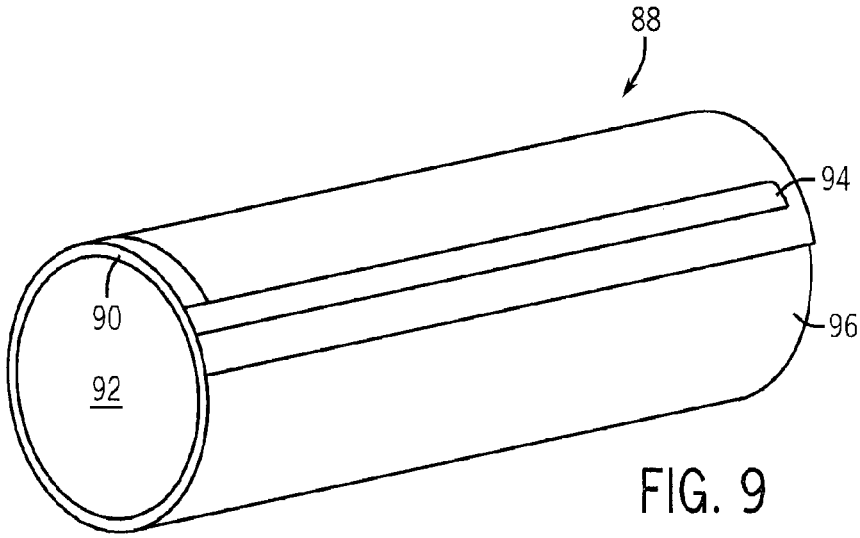
FIG. 9 is a perspective view of paper towel core according to another embodiment of the present invention.

Further, in a preferred embodiment, and with reference to FIG. 9, a web material roll 88 has a core 90 that is partially treated with conductive material, such as ring 92. Glue or similar adhesive 94 is then used to secure the tail 96 of web material to the exterior surface of the core 90. The adhesive 94 is applied so as to overlay the ring 92 of conductive material. This allows the conductive ring 92 to be damaged when the tail 96 of web towel material is pulled from the core 90. Thus, the frequency altering effect of the core will no longer result in match with the reference frequency or value. This prevents the core from being re-loaded with web material not designed to be dispensed by the dispenser. In one preferred embodiment, the ring 92 includes conductive material that is applied as paint to the outer surface of the core 90. Alternately, the conductive material could be sprayed, rolled, or stamped on the core. Also, electro-static techniques could be used to apply the conductive material. In yet another example, the core could be dipped in conductive paint or other fluid or even impregnated in the adhesive used to attach to roll tail.

Additionally, while the invention has been described with respect to a web material dispenser that advances a continuous sheet of paper towel from a roll, it is contemplated that the present invention may be used with web dispensers that dispense other types of paper products, such as toilet paper, and tissue papers. Coreless rolls and dispensers without support hubs may be used with the present invention. Further, the present invention may be used with non-paper dispensers.

Many changes and modifications could be made to the invention without departing from the spirit thereof. The scope of these changes will become apparent from the appended claims.

We claim:

1. An apparatus for dispensing product from a roll, the apparatus comprising:

a drive roller adapted to advance product from a roll;

an inductive field generator configured to generate an electromagnetic field proximate a portion of the roll; and a controller associated with the inductive field generator and adapted to determine if an alteration of the electromagnetic field by the roll substantially matches an expected alteration of the electromagnetic field for an authorized roll placed on the drive roller, and if the altered electromagnetic field substantially matches the expected alteration, then permit the drive roller to advance the product from the roll.

2. The apparatus of claim 1 wherein the inductive field generator includes a coil and an oscillator, and wherein the controller drives the oscillator to provide a waveform that is emitted by the coil, the waveform having a characteristic frequency, and compares the waveform as modified by the roll, to determine if the roll is authorized for use with the apparatus.

3. The apparatus of claim 2 wherein the roll comprises a ring of conductive material.

4. The apparatus of claim 3 wherein the conductive material is arranged on the roll in a predefined pattern.

5. The apparatus of claim 3 wherein the conductive material comprises metallic material.

6. The apparatus of claim 3 wherein the roll includes a roll core and web material wrapped around the roll core.

7. The apparatus of claim 6 wherein the roll core cannot provide an alteration to the electromagnetic field that substantially matches the expected alteration when product is substantially completely removed from the roll core.

8. The apparatus of claim 6 wherein the expected alteration is defined by the amount of conductive material in the ring of conductive material formed on the roll core.

9. The apparatus of claim 8 wherein the conductive material includes conductive paint applied to an exterior surface of the roll core.

10. The apparatus of claim 1 wherein the alteration of the electromagnetic field provides information identifying at least one of roll brand, roll type, and roll size.

11. The apparatus of claim 1 wherein the controller is further configured to provide a user-discernible indication that the drive roller has been locked out.

12. A method of regulating product dispensing from a dispenser, the method comprising:

creating an inductive electromagnetic field having a characteristic frequency proximate a roll loaded into the dispenser and configured to be incrementally advanced by a drive motor;

detecting a change to the characteristic frequency, the change created by the presence of a closed loop associated with the roll;

comparing the changed frequency to a verification frequency; and enabling motorized advancement of the product if the changed frequency substantially matches the verification frequency.

13. The method of claim 12 wherein creating the electromagnetic field includes driving an oscillator to feed a signal having the characteristic frequency to a coil proximate the roll.

14. The method of claim 13 further comprising controlling a drive motor to advance the product a predefined amount based on the changed frequency associated with the loaded roll.

15. The method of claim 13 further comprising determining a roll brand from the changed frequency.

16. The method of claim 15 further comprising determining a roll type, or a roll size, from the changed frequency.

* * * * *

UNITED STATES PATENT AND TRADEMARK OFFICE

CERTIFICATE OF CORRECTION

PATENT NO. : 8,544,785 B2
APPLICATION NO. : 12/739331
DATED : October 1, 2013
INVENTOR(S) : Mike Pelland et al.

It is certified that error appears in the above-identified patent and that said Letters Patent is hereby corrected as shown below:

On the title page item (73) Assignee, delete "Elkhom" and substitute therefore -- Elkhorn --.

Signed and Sealed this
Twenty-second Day of July, 2014

Michelle K. Lee

Michelle K. Lee
*Deputy Director of the United States Patent and Trademark Office*